US007823410B2

(12) United States Patent
Ishii et al.

(10) Patent No.: US 7,823,410 B2
(45) Date of Patent: Nov. 2, 2010

(54) COOLING DEVICE

(75) Inventors: Shigeru Ishii, Ohta-ku (JP); Kazunori Terasaki, Shimonoseki (JP)

(73) Assignee: Air Operation Technologies Inc., Yamaguchi (JP)

( * ) Notice: Subject to any disclaimer, the term of this patent is extended or adjusted under 35 U.S.C. 154(b) by 845 days.

(21) Appl. No.: 10/577,269

(22) PCT Filed: Oct. 26, 2004

(86) PCT No.: PCT/JP2004/015847

§ 371 (c)(1),
(2), (4) Date: Apr. 26, 2006

(87) PCT Pub. No.: WO2005/043053

PCT Pub. Date: May 12, 2005

(65) Prior Publication Data

US 2007/0074530 A1 Apr. 5, 2007

(30) Foreign Application Priority Data

Oct. 27, 2003 (JP) ..... 2003-365707

(51) Int. Cl.
*F25D 25/02* (2006.01)

(52) U.S. Cl. ..... 62/381; 62/419

(58) Field of Classification Search ..... 62/381, 62/157, 186, 407, 408, 419, 440, 6, 93, 180, 62/415; 454/329, 15, 140
See application file for complete search history.

(56) References Cited

U.S. PATENT DOCUMENTS 3,405,281 A * 10/1968 Wilson ..... 307/38
4,229,945 A * 10/1980 Griffin et al. ..... 62/229
4,924,680 A * 5/1990 Janke et al. ..... 62/187
5,896,748 A * 4/1999 Park ..... 62/179
6,055,826 A * 5/2000 Hiraoka et al. ..... 62/408
6,427,455 B1 * 8/2002 Furubayashi ..... 62/93
6,574,968 B1 * 6/2003 Symko et al. ..... 62/6

FOREIGN PATENT DOCUMENTS

| | | |
|---|---|---|
| JP | 6-273030 | 9/1994 |
| JP | 8-200923 | 8/1996 |
| JP | 2852300 | 11/1998 |
| JP | 3366977 | 11/2002 |
| WO | 99/047871 | 9/1999 |

* cited by examiner

*Primary Examiner*—Mohammad M Ali
(74) *Attorney, Agent, or Firm*—Hamre, Schumann, Mueller & Larson, P.C.

(57) ABSTRACT

In a cooling device for cooling an object to be cooled without using a forced cold air circulating system, which circulates cold air forcibly, a cooling device at a practical level is provided, and a cooling device capable of achieving a sufficient cooling effect is provided. A cooler 18 is provided in an interior that is insulated adiabatically from an exterior, a cooling fan 20 is disposed on a front surface of the cooler 18, a cooling chamber 22 in which an object to be cooled is placed is defined by a space in front of the cooling fan 20, a cooled air behind the cooling fan 20 is drawn with the fan and allowed to flow into the cooling chamber 22, and a/D=½ to ¼ is satisfied, where a indicates a dimension of a gap between the cooler 18 and the cooling fan 20 along a front-back direction and D indicates a diameter of the cooling fan 20.

12 Claims, 12 Drawing Sheets

COOLING DEVICE

TECHNICAL FIELD

The present invention relates to a cooling device for cooling an object to be cooled without using a forced cold air circulating system that circulates cold air forcibly.

BACKGROUND ART

A conventional forced cold air circulating system has circulated cold air by sending with a fan the air cooled by a cooler such as a cooling coil forcibly from a blowing port into a cooling chamber in which an object to be cooled is placed, withdrawing the cold air whose temperature has risen due to heat exchange with the object to be cooled from a suction port to the cooler, cooling the air with the cooler again and sending the air to the cooling chamber with the fan. In this system, the cold air is blown against the surface of the object to be cooled, thereby cooling the object while removing moisture as well as hot air from the object.

Accordingly, the forced cold air circulating system has the following problems. 1) As the object to be cooled dries, its natural moisture is taken away. In the case where the object to be cooled is a food material, its taste and quality deteriorate. 2) The moisture is taken from the object to be cooled, so that, in a freezing temperature range, ice crystals attract each other and grow into larger crystals, thus swelling and also engulfing intracellular elements of the object to be cooled, resulting in degeneration of the object. 3) Since the circulating path of the cold air is fixed, the time during which the air is in contact with the object to be cooled is short, making it difficult to conduct quick cooling. 4) Because of the high speed of cold air, powder of some objects to be cooled may be scattered and make an interior dirty. 5) The moisture taken from the object to be cooled returns to the cooler, causing a frost deposition. This necessitates defrosting. 6) Since the interior temperature rises during defrosting, fine ice crystals start melting. The melted ice crystals freeze to form large crystals, which destroy the cells, thus changing the object to be cooled. When the object is preserved for a long time, its elements become broken.

In order to solve these problems, JP 2852300 B (Patent document 1) and JP 3366977 B (Patent document 2) have suggested cooling devices that do not circulate cold air forcibly. In these cooling devices, a cooler is provided on a side of one wall in a chamber sealed by a heat-insulating housing, a front surface of the cooler is provided with a cooling fan, a space in front of the cooling fan serves as a cooling chamber, and cooled air present near the cooler is withdrawn from a back surface of the cooling fan and allowed to flow into the cooling chamber. The cooled air in the cooling chamber is not circulated forcibly to the cooler, and a heat exchange by collision of molecules between the cooling chamber and a cooling portion including the cooler is carried out at an interface between air layers of the cooling portion and the cooling chamber. Thus, the cooling chamber has a saturated water vapor pressure and is not dry, so that a slight amount of moisture on the surface of the object to be cooled is frozen instantaneously to form a thin ice barrier over the entire surface. This makes it possible to keep the ice crystals in the object to be cooled microscopically, thereby avoiding the degeneration of the object.

According to the description in JP 3366977 B, it is appropriate that a gap between a back surface of the cooling coil serving as the cooler and the wall surface of the chamber range from 20 to 50 mm. A gap smaller than the above does not allow a sufficient amount of cold air to be withdrawn, whereas an excessively large gap causes the cold air to be distributed in that gap, preventing the guidance of the cold air to the space behind the fan.

However, the studies conducted by the inventors of the present invention have revealed not only that the gap with the above-noted numerical range does not produce a sufficient cooling effect but also that there is a condition that should be satisfied in order to provide a practical cooling device. In other words, there is a problem that it is impossible or insufficient for achieving a cooling device at a practical level to satisfy only the condition described in the conventional documents mentioned above.

Patent document 1: JP 2852300 B

Patent document 2: JP 3366977 B

DISCLOSURE OF INVENTION

Problem to be Solved by the Invention

The present invention was made with the foregoing problems in mind, and the problem to be solved by the present invention is to provide a cooling device at a practical level and a cooling device capable of achieving a sufficient cooling effect, in a cooling device for cooling an object to be cooled without using a forced cold air circulating system that circulates cold air forcibly.

Means for Solving Problem

In order to solve the above-described problems, the present invention is characterized by a cooling device including a cooler provided in an interior that is insulated adiabatically from an exterior, a cooling fan disposed on a front surface of the cooler, and a cooling chamber that is defined by a space in front of the cooling fan and in which an object to be cooled is placed. The cooling device draws cooled air behind the cooling fan with the fan and allows the cooled air to flow into the cooling chamber. $a/D=\frac{1}{2}$ to $\frac{1}{4}$ is satisfied, where a indicates a dimension of a gap between the cooler and the cooling fan along a front-back direction and D indicates a diameter of the cooling fan.

Further, it is preferable that a dimension of a gap between the cooler and a wall surface on a back surface side of the cooler is set to be equal to or larger than 50 mm.

The second aspect of the invention is a cooling device including a cooler provided in an interior that is insulated adiabatically from an exterior, a cooling fan disposed on a front surface of the cooler, and a cooling chamber that is defined by a space in front of the cooling fan and in which an object to be cooled is placed. The cooling device draws cooled air behind the cooling fan with the cooling fan and allows the cooled air to flow into the cooling chamber. A dimension of a gap between the cooler and a wall surface on a back surface side of the cooler is set to be larger than 50 mm.

The above-described second aspect of the invention is characterized in that a lateral surface of the cooler is covered with a control plate so as to prevent substantially air from moving in and out through the lateral surface of the cooler.

The number of revolutions of the cooling fan can be made adjustable. Preferably, the number of revolutions can be 1200 to 2100 rpm.

The cooling device further can include in the cooling chamber a vibration driving portion for vibrating a placement stage on which the object to be cooled is placed.

Moreover, the coolers are provided so as to face each other with the cooling chamber interposed therebetween, and the cooling fans provided respectively on the front surfaces of the facing coolers can be offset so as not to face each other.

Additionally, the number of the cooling fans provided on the front surface of the cooler is more than one, and when the front surface of the cooler is divided virtually into a plurality of blocks, the cooling fans can be arranged on the front surface corresponding to blocks selected in a staggered manner.

Also, it is appropriate that a rotation of the cooling fan (viewed from the downstream side) is set to be counterclockwise in the Northern Hemisphere and clockwise in the Southern Hemisphere.

Effects of the Invention

According to the present invention, in a cooling device for cooling an object to be cooled without using a forced cold air circulating system that circulates cold air forcibly, the speed of the air flowing in a cooling chamber is set to low, the generation of a flow passing through a cooler is minimized, and frost is made to form in the cooling chamber forward of a cooling fan and prevented from forming on the cooler. Thus, it becomes possible to achieve an efficient and sufficient cooling effect at a practical level.

DESCRIPTION OF THE INVENTION

The following is a description of embodiments of the present invention, with reference to the accompanying drawings. It should be noted that the embodiments below do not limit the present invention.

Figure 1A:
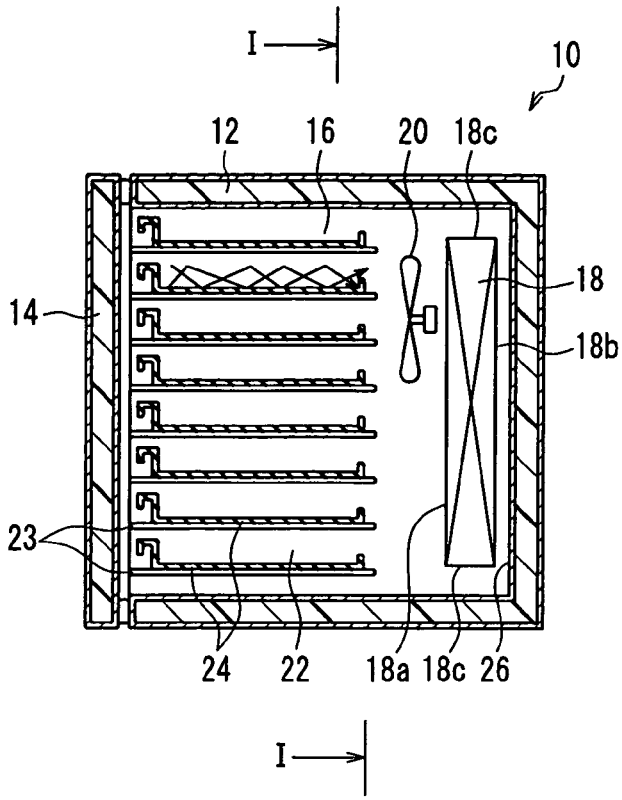
FIGS. 1A to 1B show an internal structure of a cooling device according to the first embodiment of the present invention, with FIG. 1A showing a vertical lateral cross-section thereof and FIG. 1B showing a cross-section thereof (except for trays) taken along a line I-I in FIG. 1A.
Figure 1B:
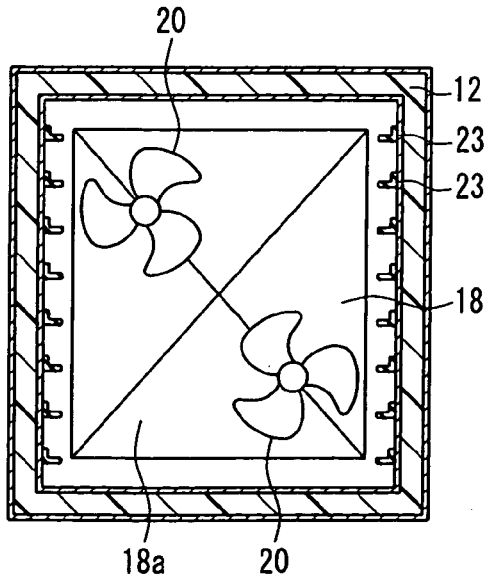

FIGS. 1A to 1B are sectional views showing an internal structure of a cooling device according to the first embodiment of the present invention. A cooling device 10 has an interior 16 that is surrounded by a heat-insulating wall 12 so as to be insulated adiabatically from the exterior. One lateral surface (front surface) of the interior 16 is provided with a door 14 that can be opened and closed freely for carrying an object to be cooled in and out.

A cooler 18 is provided in the interior 16. An overall shape of the cooler 18 usually is a rectangle (including a square) viewed from the front surface thereof. The cooler 18 is connected with a compressor and a condenser that are disposed externally (not shown), and a refrigerant circulates therethrough. The cooler 18 serves as an evaporator for cooling the ambient air by evaporation of the refrigerant and can be constituted by, for example, cooling coils around which cooling fins are formed. The air can move between the cooling fins of the adjacent cooling coils in any of a vertical direction, a front-back direction and a transverse direction and basically can flow into and out of the cooler 18 from all of the four side directions of a back surface, both lateral surfaces and a front surface of the cooler 18.

A front surface of the cooler 18 is provided with cooling fans 20 having a motor. It is appropriate that a plurality of the cooling fans 20 be provided. In this example, a pair of the cooling fans 20 are arranged diagonally opposite to each other when viewed from the front surface of the cooler 18. These cooling fans 20 are not provided with a bell mouth, which conventionally has been used in general for increasing the volume of air flow.

A space in the interior 16 in front of the cooling fans 20 serves as a cooling chamber 22. Both lateral surfaces of the interior 16 are provided with guide rails 23, along which a plurality of trays 24 are disposed. An object to be cooled can be placed on these trays 24.

In the system according to the present invention, which does not use the forced cold air circulating system circulating cold air forcibly, the following is important for enhancing a heat exchange efficiency. That is, circulation is not caused forcibly between a cooling portion including the cooler 18 and the cooling chamber 22, and a low-speed air turbulence is generated in the cooling chamber 22. Further, the generation of a flow passing through the cooler 18 is minimized so as to prevent frost from forming on the cooler 18, thus causing a sufficient heat exchange between the cooling chamber 22 and the cooling portion.

In order to satisfy the above-noted conditions, the inventors of the present invention have found that it is necessary to set appropriate numerical values of 1) a dimension of a gap between the cooler 18 and the cooling fan 20 along a front-back direction, 2) a dimension of a gap between the cooler 18 and a wall surface 26 facing a side of the cooler 18 opposite to the cooling fan 20, namely, a back surface side of the cooler 18 and 3) the number of revolutions of the cooling fan. In the following, they will be studied sequentially.

1) Study of the Gap Between the Cooler 18 and the Cooling Fan 20 Along the Front-Back Direction In the present invention, the gap between the cooler 18 and the cooling fan 20 along the front-back direction is not reduced but set to a predetermined range. This predetermined range is a/D=½ to ¼, where a indicates the dimension of the gap between the cooler 18 and the cooling fan 20 along the front-back direction and D indicates the diameter of the cooling fan 20. This range is the most effective.

Figure 2C:
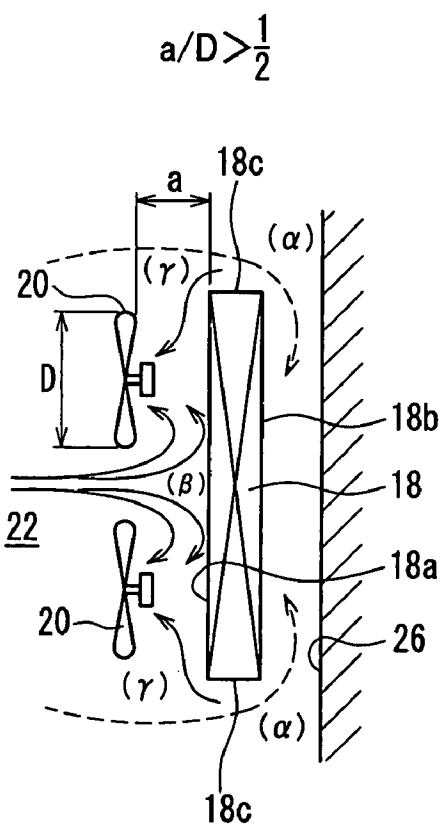
FIGS. 2A to 2C are sectional views for describing the relationship between air flows generated in an interior and a gap in a front-back direction between a cooler and a cooling fan.
Figure 2B:
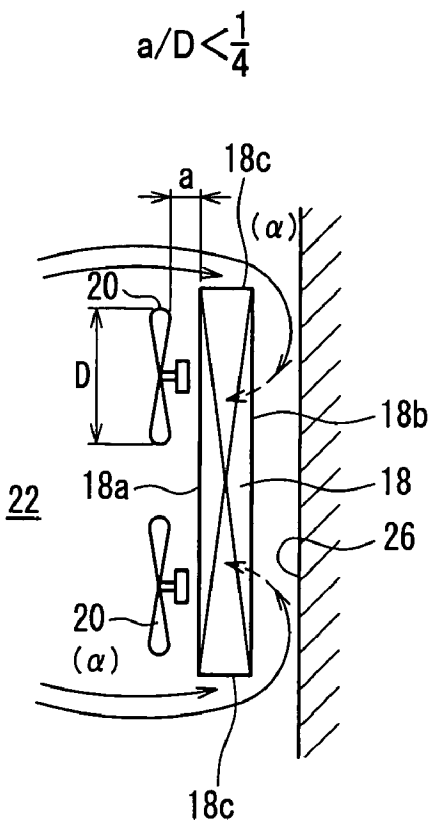
Figure 2A:
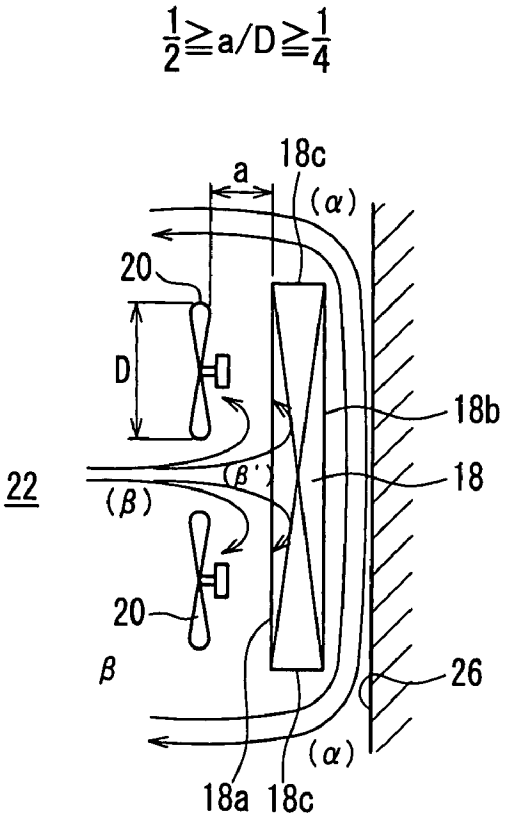

As shown in FIGS. 2A to 2C, in the case of a configuration in which all of the four side directions of a back surface 18*b*, both lateral surfaces 18*c*, 18*c* and a front surface 18*a* of the cooler 18 are open, the air flow generated in the cooling portion can be a flow that comes from the side of the cooling chamber 22, moves around the back surface 18*b* and the both lateral surfaces 18*c*, 18*c* of the cooler 18 and flows into the cooling chamber 22 (represented by (α) in the figure), a flow that comes from the side of the cooling chamber 22, goes around a space behind the cooling fan 20, is drawn by the cooling fan 20 and then flows into the cooling chamber 22 again (represented by (β) in the figure) and a flow that is drawn from the ambient space of the cooler 18 to the cooling fan 20 (represented by (γ) in the figure). It is ideal that the flow (α) and the flow (β) among them are distributed in good balance, whereby the air that has been warmed up by the object to be cooled and flowed from the side of the cooling chamber 22 exchanges heat with the ambient air of the cooler 18 that has been cooled by the cooler 18, and flows toward the cooling chamber 22. At this time, it is desired that a minimal volume of the highly humid air flowing from the side of the cooling chamber 22 should enter the cooler 18, thus preventing frost from forming on the cooler 18. Furthermore, it is important for enhancing the heat exchange efficiency to lower the speed of the air so as to allow a sufficient heat exchange with the air cooled by the cooler 18 and to keep the speed of the air flowing into the cooling chamber 22 low so as to allow a sufficient heat exchange with the object to be cooled.

As shown in FIG. 2B, when a/D<¼, the cooling fan 20 and the cooler 18 are too close. Thus, it is not possible to generate the flow (β) sufficiently, so that the sufficient air cannot flow into the cooling chamber 22. Accordingly, the suction force has to be enhanced by increasing the number of revolutions of the cooling fan 20, or the like. This raises the flow speed and draws the air inside the cooler 18, thus causing a problem that the flow passing through the cooler 18 is generated. Actively generating the flow of air passing through the cooler 18 should be avoided because it guides the highly humid air from the cooling chamber 22 into the cooler 18, resulting in frost formation on the cooler 18.

On the other hand, as shown in FIG. 2C, when a/D>½, the cooling fan 20 and the cooler 18 are spaced too far. Thus, the air accumulates in a space behind the cooling fan 20, causing a problem that the volume of air blown from the cooling fan 20 toward the cooling chamber 22 increases. Also, the air in the flow (β) cannot exchange heat sufficiently with the ambient air cooled by the cooler 18. Furthermore, the flow (γ) that comes from the ambient space of the cooler 18 and is drawn by the cooling fan 20 without moving around the cooler 18 is generated more than the flow (α) moving around the three surfaces of the both lateral surfaces 18*c*, 18*c* and the back surface 18*b* of the cooler 18, causing a problem that the heat exchange between the flow from the side of the cooling chamber 22 and the ambient air cooled by the cooler 18 cannot be carried out sufficiently. In other words, the cooling portion and the cooling chamber 22 function as if they were separated completely, resulting in a poor heat exchange efficiency.

In contrast, as shown in FIG. 2A, by satisfying ½≧a/D≧¼, the flow (α) moving around the both lateral surfaces 18*c*, 18*c* and the back surface 18*b* of the cooler 18 and the flow (β) passing across the front surface of the cooler 18 are generated in good balance, thereby allowing a sufficient heat exchange between the flow from the side of the cooling chamber 22 and the ambient air cooled by the cooler 18. Of course, a slight volume of air moves into and out of the cooler 18 (see β'), but it stirs the air inside the cooler 18, thus contributing to facilitated heat exchange. However, it still is possible to suppress the generation of a large volume of air flow passing from the cooling chamber 22 into the cooler 18.

Figure 4:
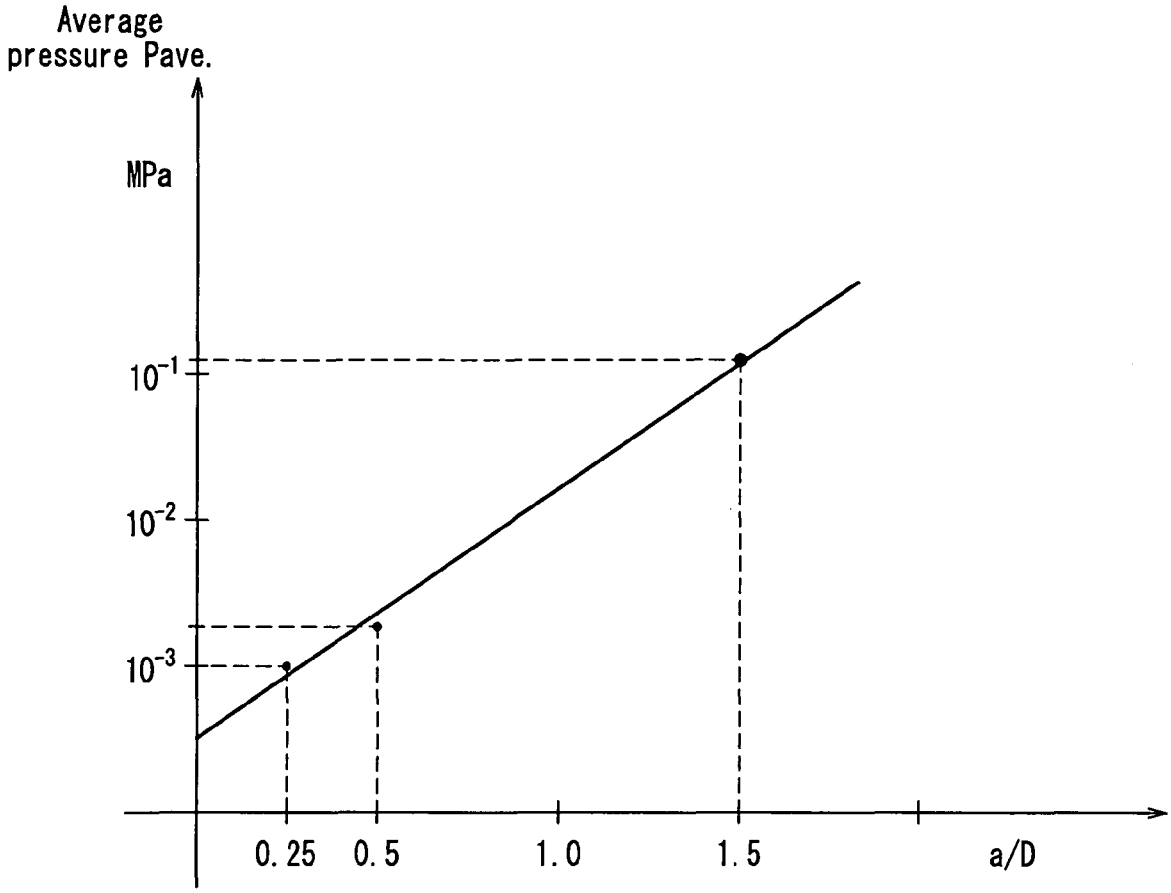
FIG. 4 is a graph showing results of measuring an average pressure of a flow generated in a cooling chamber with respect to various values of a ratio a/D of a dimension a of the gap between the cooler and the cooling fan along the front-back direction to a diameter D of the cooling fan.

FIG. 4 is a graph showing results of measuring a pressure of the flow generated in the cooling chamber 22 with respect to various values of a ratio a/D of the dimension a of the gap between the cooler 18 and the cooling fan 20 along the front-back direction to the diameter D of the cooling fan 20 described above. An average pressure was measured at a point in the cooling chamber 22 located 100 mm forward of the point of rotational center of the cooling fan 20 (in the following, referred to as a measurement point) when the cooling fan 20 had a diameter D=200 mm.

As becomes clear from FIG. 4, the average pressure was 1200 gf/cm$^2$=0.12 MPa when a=300 mm (a/D=1.5), the average pressure was 18 gf/cm$^2$=0.0018 MPa when a=100 mm (a/D=0.5), and the average pressure was 10 gf/cm$^2$=0.001 MPa when a=50 mm (a/D=0.25). From these values, the relationship $\log P_{ave}=\alpha+\beta\cdot(a/D)$, where $\alpha\approx0.50$ and $\beta\approx1.71$ (note: the unit of $P_{ave}$ is gf/cm$^2$) can be understood. The pressure to the object to be cooled should neither be too large nor too small and preferably ranges from 10 gf/cm$^2$ to 28 gf/cm$^2$. Thus, it is understood that the range of a/D should be about a/D=¼ to ½.

The cooled air sent from the cooling fan 20 to the cooling chamber 22 collides with the cooled air reflected by a wall surface that is opposed to the cooling fan 20 (the door 14 or a front surface of the tray 24 in the exemplary case of FIG. 1), turns into a turbulent state and contacts the object to be cooled.

Figure 5:
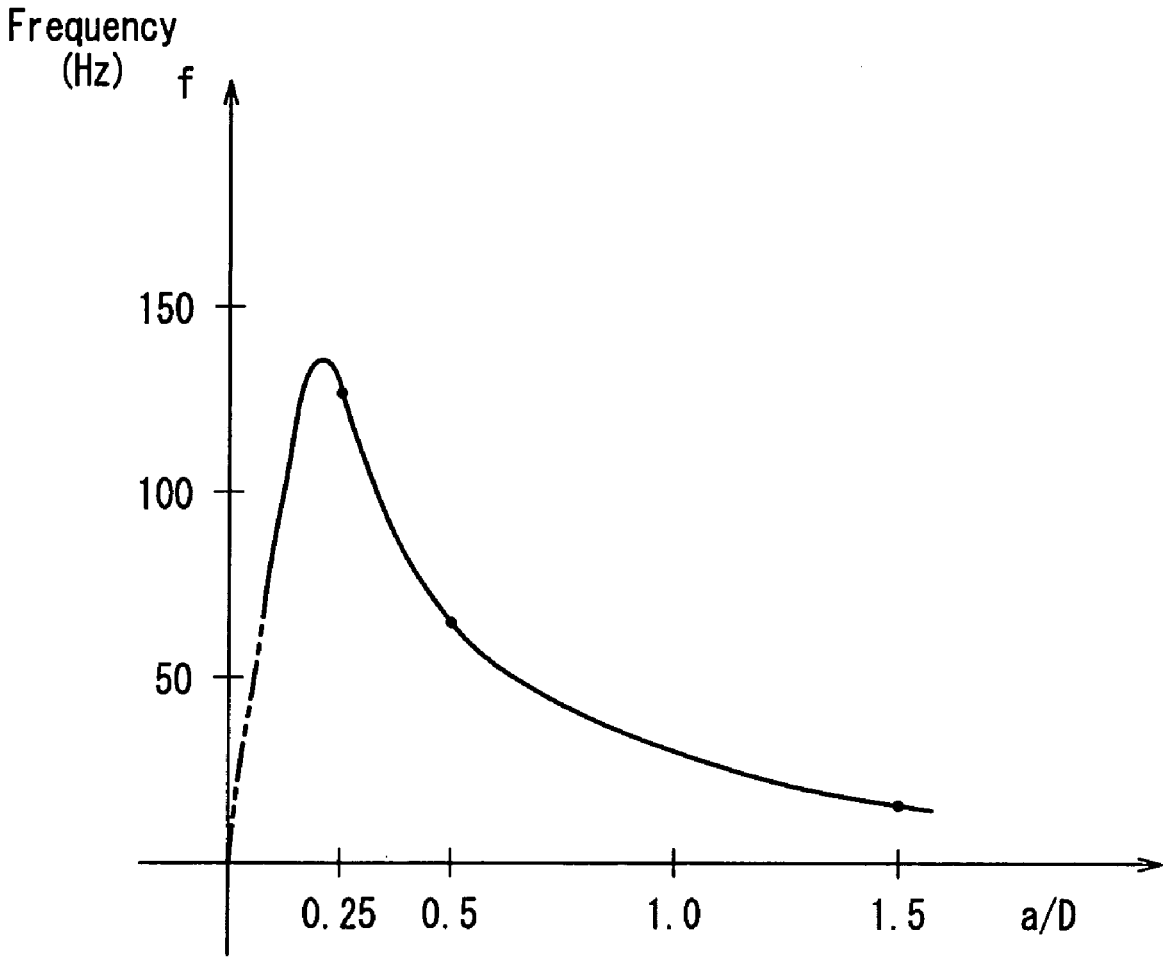
FIG. 5 is a graph showing results of measuring a frequency f of a pressure pulsation of the flow generated in the cooling chamber with respect to various values of the ratio a/D of the dimension a of the gap between the cooler and the cooling fan along the front-back direction to the diameter D of the cooling fan.

At the measurement point, the pressure is oscillating or pulsing. FIG. 5 shows results of measuring the relationship between a/D and a frequency f of that pressure pulsation. If the frequency f of the pulsation is high, a heat-insulating air layer, which may be built up at an interface between the object to be cooled and the ambient air, can be removed to enhance the heat exchange rate with the object, thus achieving a high cooling effect. From the results shown in FIG. 5, it is understood that the frequency can be enhanced when a/D is in a certain range. The reflection of the cooled air occurring in the space between the cooling fan 20 and the cooler 18 is assumed to have a considerable influence on the pressure pulsation generated in the cooling chamber 22. It is understood that the pressure pulsation is maximal, in other words resonance occurs, in the vicinity of a/D=¼. By selecting an appropriate dimension a of that space, it is possible to produce an appropriate frequency. When a/D is in the range of ¼ to ½, a fully satisfactory frequency can be achieved. Further, in this range, the size of ice crystals formed on the object to be cooled was ⅕ to 1/10 of that of ice crystals formed in the case of the forced circulating system.

Figure 6:
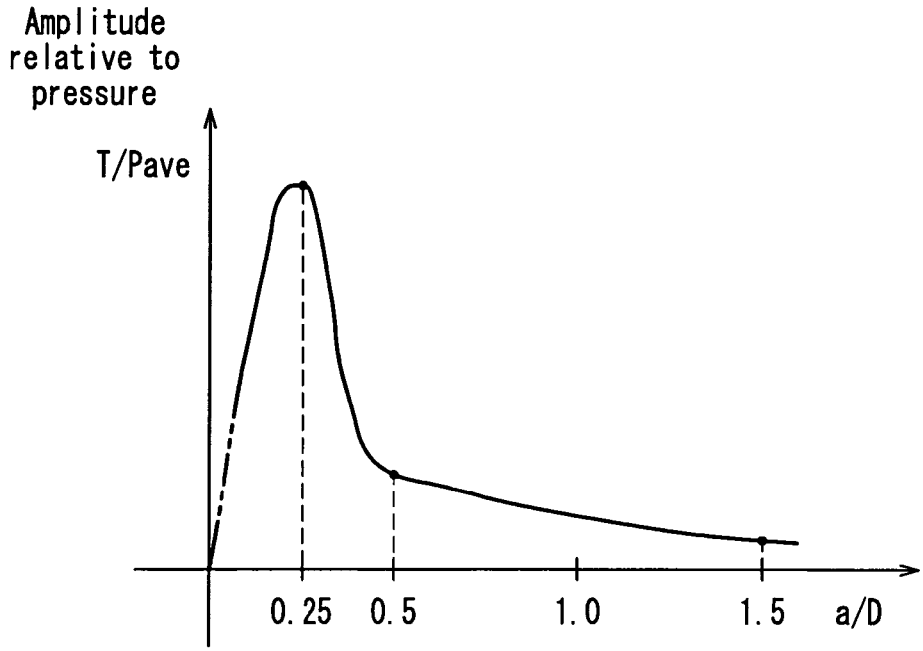
FIG. 6 is a graph showing results of measuring a relative amplitude $T/P_{ave}$ of the pressure pulsation of the flow generated in the cooling chamber with respect to various values of the ratio a/D of the dimension a of the gap between the cooler and the cooling fan along the front-back direction to the diameter D of the cooling fan.

FIG. 6 shows results of measuring the relationship between a/D and a relative amplitude $T/P_{ave}$, which is the ratio of an amplitude T of the pressure pulsation to the average pressure $P_{ave}$ at the measurement point. Similarly to the frequency f of the pulsation, if the relative amplitude $T/P_{ave}$ of the pulsation is large, an effect of cooling the object to be cooled can be enhanced. From the results in FIG. 6, it is understood that the relative amplitude can be increased when a/D is in a certain range. When a/D is in the range of ¼ to ½, a fully satisfactory relative amplitude can be achieved.

Incidentally, it was confirmed by an experiment that, when a/D was smaller than ¼, the flow (β) was not generated, leading to an insufficient heat exchange, and the flow passing through the cooler 18 was generated, resulting in the frost deposition on the cooler 18, as described earlier.

2)Study of the dimension of the gap between the cooler 18 and the wall surface 26 on the back surface side of the cooler 18

Figure 3C:
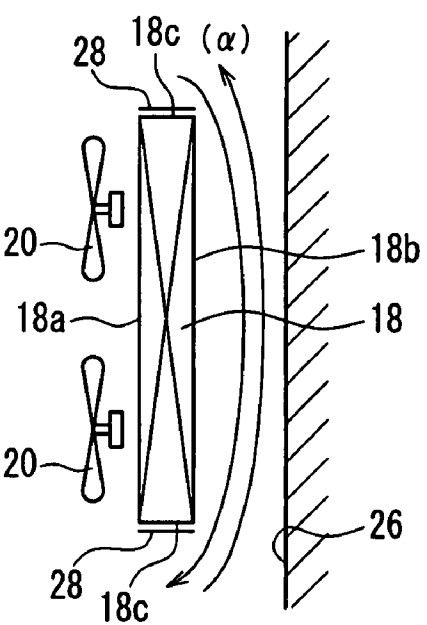
FIGS. 3A to 3C are sectional views for describing the relationship between the air flows generated in the interior and a gap between the cooler and a wall surface on a back surface side of the cooler.
Figure 3B:
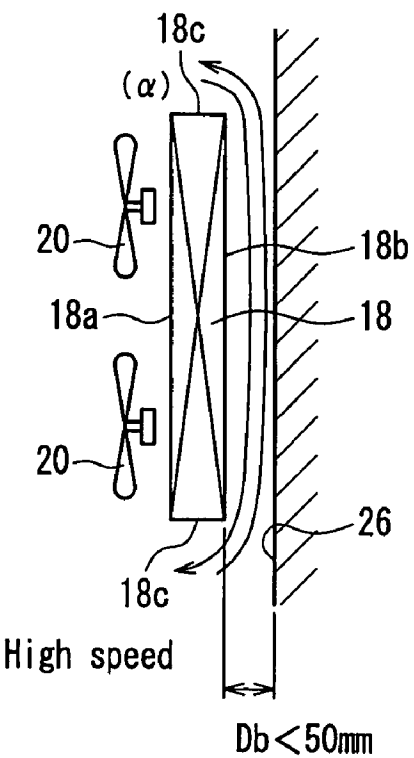
Figure 3A:
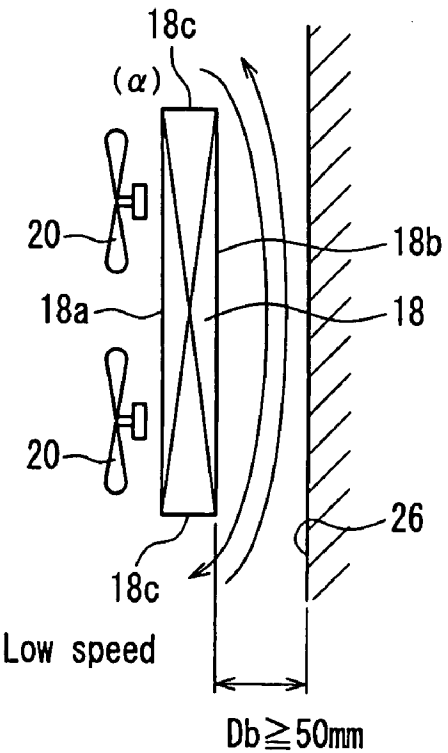

The distance Db between the cooler 18 and the wall surface 26 on the back surface side of the cooler 18 smaller than 50 mm as shown in FIG. 3B is not preferable because a narrowing effect by this gap raises the speed of the flow (α) moving around the three surfaces of the both lateral surfaces 18*c*, 18*c* and the back surface 18*b* of the cooler 18. The distance Db equal to or larger than 50 mm as shown in FIG. 3A is preferable because the speed of the above-mentioned flow moving around the three surfaces of the both lateral surfaces and the back surface of the cooler 18 becomes lower. It is desired that an average speed is 1 to 5 m/min=0.0167 to 0.0833 m/sec.

Further, the inventors of the present invention have found that the value of the distance Db is affected by a control plate placed around the cooler 18. In the case where the both lateral surfaces 18*c*, 18*c* and the back surface 18*b* of the cooler 18 are covered with the control plates, it is not possible to conduct a heat exchange between the flow (α) and the air cooled by the cooler 18, so that a cooling effect cannot be obtained. On the other hand, in the case where the both lateral surfaces 18*c*, 18*c* and the back surface 18*b* are all opened, the speed of the flow (α) moving around these surfaces tends to increase. Thus, in the case where control plates 28 are placed on the both lateral surfaces 18*c* as shown in FIG. 3C, the flow (α) cannot conduct the heat exchange on the both lateral surfaces 18*c*, 18*c* of the cooler 18, but an increase in its speed can be suppressed. Accordingly, it is sufficient that the distance Db is set to be equal to or larger than 50 mm. On the other hand, in the case of placing no control plate 28, it is appropriate that the distance Db is set to be larger than 50 mm and preferably at least 100 mm. Incidentally, these lateral surfaces 18*c* can include an upper surface and a lower surface of the cooler 18. At least one of a plurality of the lateral surfaces 18*c* may be covered with the control plate 28. Also, Db is set to be equal to or larger than 50 mm in combination with the preferable range of a/D obtained in 1) (i.e., ¼ to ½), whereby the heat exchange efficiency can be enhanced further.

Figure 7:
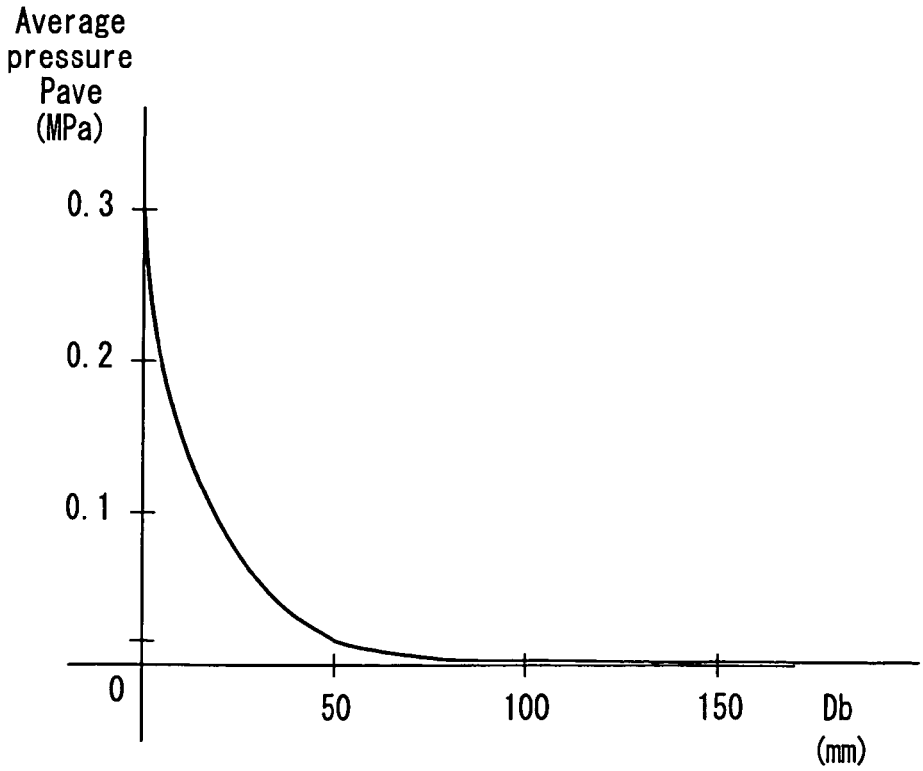
FIG. 7 is a graph showing results of measuring the relationship between an average pressure $P_{ave}$ at a measurement point that is the same as that in FIGS. 5 and 6 and a distance Db of the gap between the cooler and the wall surface on the back surface side of the cooler.

FIG. 7 is a graph showing results of measuring the relationship between the distance Db and the average pressure $P_{ave}$ at the measurement point that is the same as that in FIGS. 5 and 6 (where a/D=½). A smaller average pressure indicates a lower speed of the flow from the cooler 18 toward the cooling chamber 22. A smaller distance Db increases the pressure, thus affecting the object to be cooled adversely. When the distance Db is extended to a certain degree, the pressure no longer depends on the distance Db and becomes constant. It is understood from the graph that a threshold at this time should be Db>50 mm and preferably Db≧100 mm.

3) Study of the Number of Revolutions of the Cooling Fan

Naturally, the number of revolutions of the cooling fan 20 also influences the speed of flow in the cooling chamber 22. Thus, in the case where the dimension a studied in 1) cannot be made sufficiently small, it is possible to adjust the number of revolutions of the cooling fan 20 instead. For that purpose, the motor driving the cooling fan 20 is controlled by an inverter.

Figure 8:
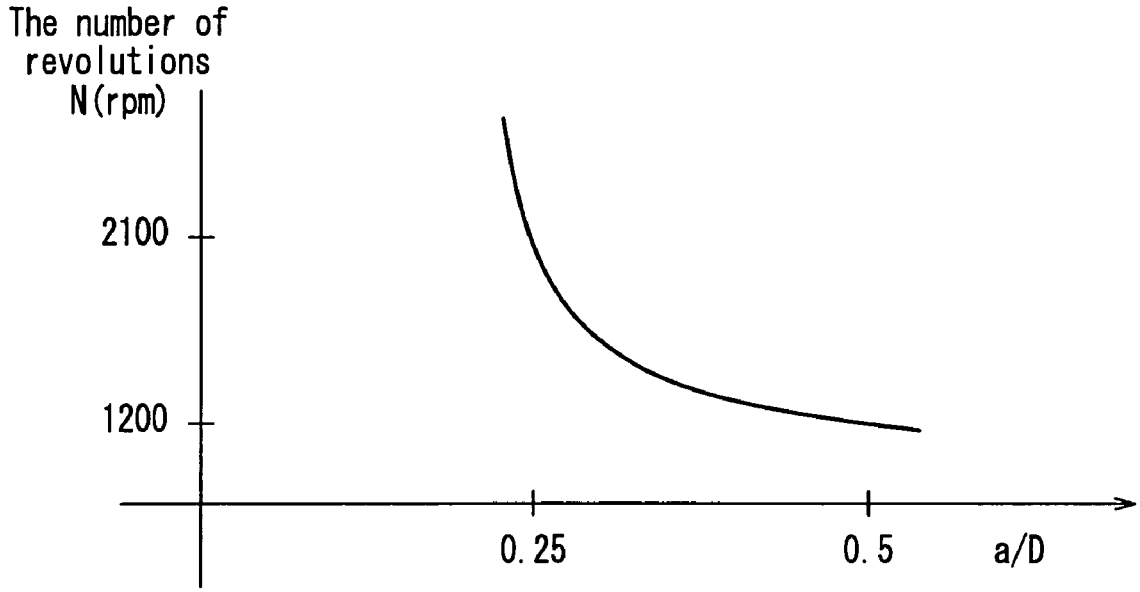
FIG. 8 is a graph showing the relationship between the number of revolutions of the cooling fan and the ratio a/D of the dimension a of the gap between the cooler and the cooling fan along the front-back direction to the diameter D of the cooling fan.

FIG. 8 shows the relationship between the distance a and the number of revolutions N. As already shown in FIG. 4, the average pressure and the speed increase exponentially with the distance a. Thus, the number of revolutions is reduced so as to cancel out that increase, thereby keeping the pressure and the speed not greater than predetermined values even when the distance a increases. For that purpose, the distance a and the number of revolutions N are adjusted according to an inverse exponential function as shown in FIG. 8, so that the cooling can be conducted under a similar condition even when the distance a changes to some extent. It is appropriate that the number of revolutions be adjusted in the range of 1200 to 2100 rpm.

Figure 9:
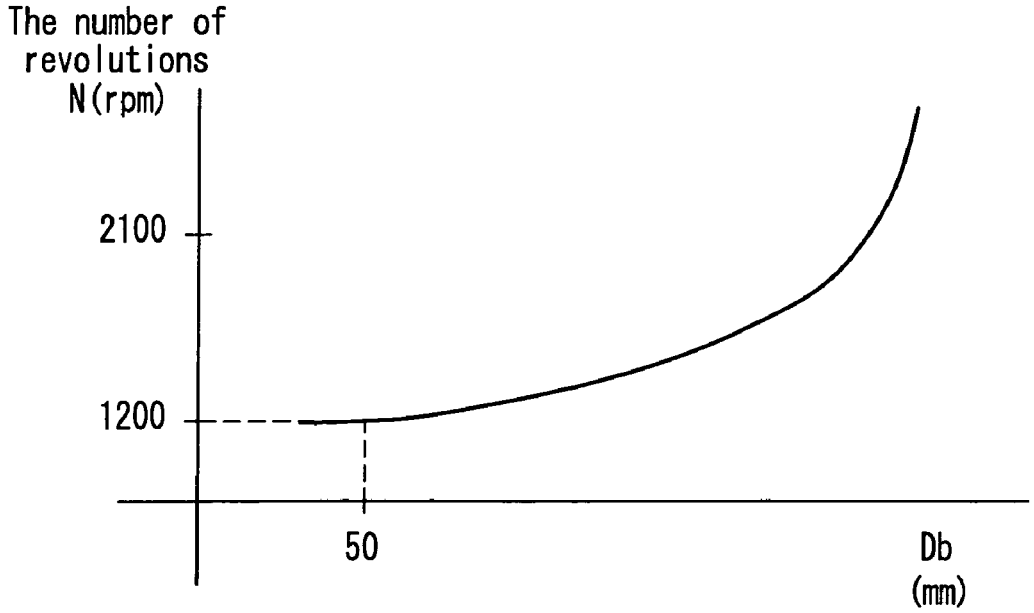
FIG. 9 is a graph showing the relationship between the number of revolutions of the cooling fan and the distance Db of the gap between the cooler and the wall surface on the back surface side of the cooler.

The relationship between the distance Db and the number of revolutions N is similar to the above. As shown in FIG. 7, the average pressure and the speed increase exponentially with a decrease in the distance Db. Thus, the number of revolutions is reduced so as to cancel out that increase, thereby keeping the pressure and the speed not greater than predetermined values even when the distance Db decreases. For that purpose, the distance Db and the number of revolutions N are adjusted according to an exponential function as shown in FIG. 9, so that the cooling can be conducted under a similar condition even when the distance Db changes to some extent. It is appropriate that the number of revolutions be adjusted in the range of 1200 to 2100 rpm.

In this manner, also in the preferable ranges of a/D and Db described above, it is possible to conduct cooling in a condition closer to ideal by adjusting the number of revolutions of the cooling fan.

Figure 10:
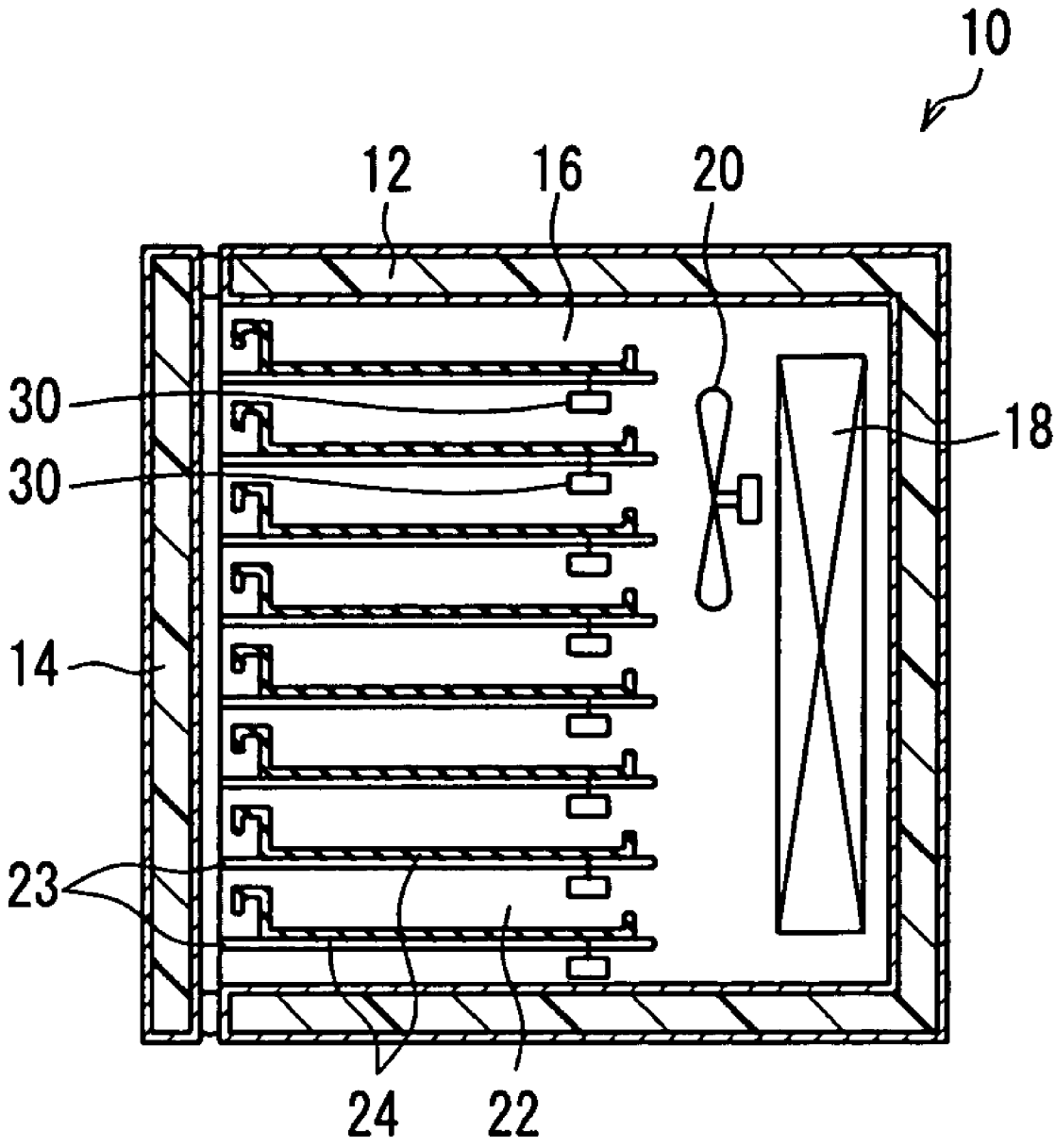
FIG. 10 shows a vertical lateral cross-section of an internal structure of a cooling device according to another embodiment of the present invention.

Next, FIG. 10 shows another embodiment. In the present embodiment, a vibration driving portion 30 further is provided for vibrating the tray 24 serving as a placement stage on which the object to be cooled is placed. The vibration driving portion 30 can be any suitable driving mechanisms. For example, it is possible to use an ultrasonic vibrator, a motor or the like as a driving source and a cam crank, a belt or the like as a driving transmission mechanism. In addition to the pressure pulsation, this applies mechanical vibrations to the object to be cooled, thereby removing the air layer at the interface between the object and the ambient air so as to achieve a higher cooling effect.

Figure 11A:
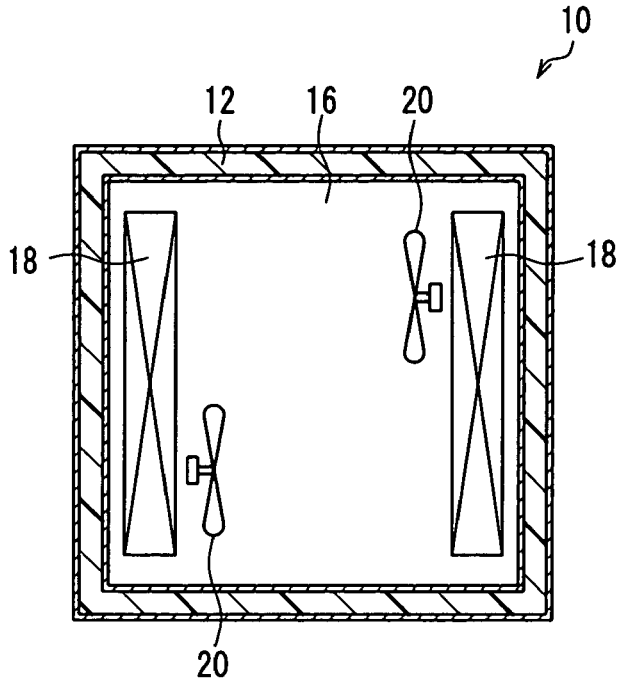
FIGS. 11A to 11B show an internal structure of a cooling device according to another embodiment of the present invention, with FIG. 11A being a vertical front sectional view thereof and FIG. 11B being a schematic perspective view showing a cooler.
Figure 11B:
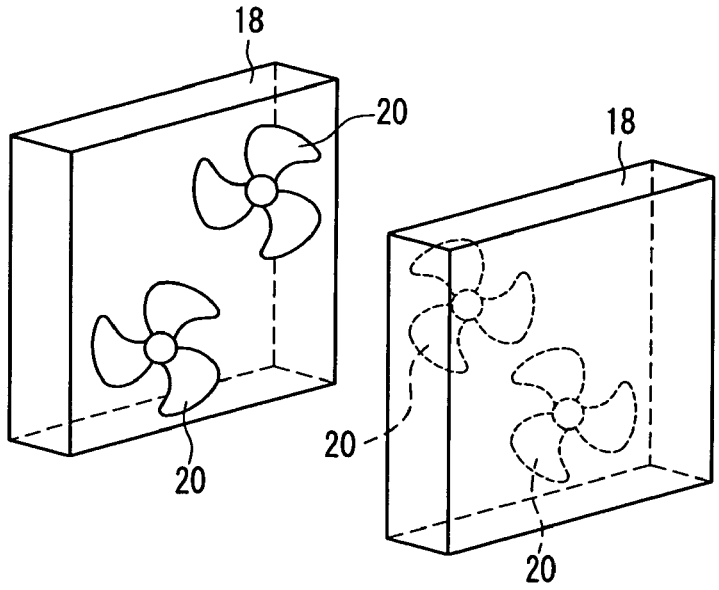

Now, FIGS. 11A to 11B show yet another embodiment. Although one side of the interior 16 that is opposed to the door 14 is provided with the cooler 18 in the example illustrated in FIGS. 1A to 1B, there is no limitation to this. The arrangement of the door 14 and the cooler 18 is not restricted at all, and the cooler 18 can be arranged at any positions in the interior 16. FIGS. 11A to 11B illustrate an example in which the coolers 18 are provided on both sides of the interior 16, and thus, the cooling portions are provided on both sides of the interior 16. In this case, it is appropriate that the cooling fans 20 provided on the front surface of each of the coolers 18 be offset alternately in a staggered manner, instead of facing each other.

Furthermore, the present invention is not limited to the above-described embodiments and can be modified as follows.

Figure 12A:
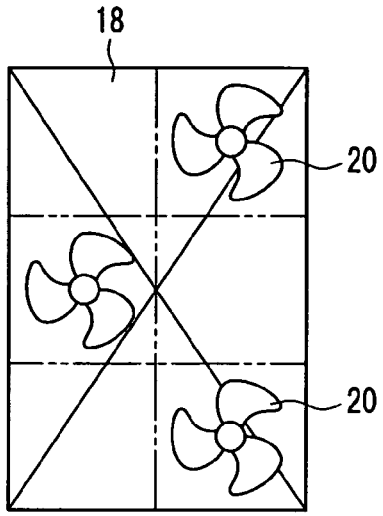
FIGS. 12A to 12B are front views showing the relationship between a cooler and cooling fans according to another embodiment of the present invention.
Figure 12B:
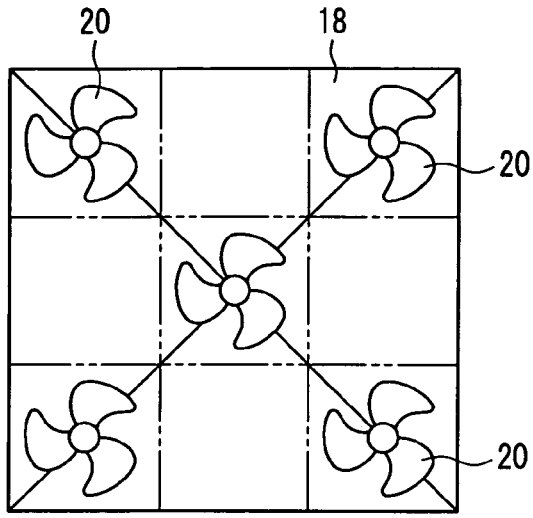

The number of the cooling fans 20 is not limited to two for each cooler as illustrated in FIGS. 1A to 1B or 11A to 11B but can be more than two as illustrated in FIGS. 12A to 12B. In this case, when the front surface of the cooler 18 is divided into a plurality of blocks, it is appropriate to place the cooling fans 20 on the front surface corresponding to blocks selected in a staggered manner from the plurality of blocks.

The rotation of the cooling fan 20 is set to be counterclockwise in the Northern Hemisphere and clockwise in the Southern Hemisphere. In this way, the cooling fan 20 can form a spiral air layer smoothly by the Coriolis force, thus achieving an improved energy efficiency.

Figure 13:
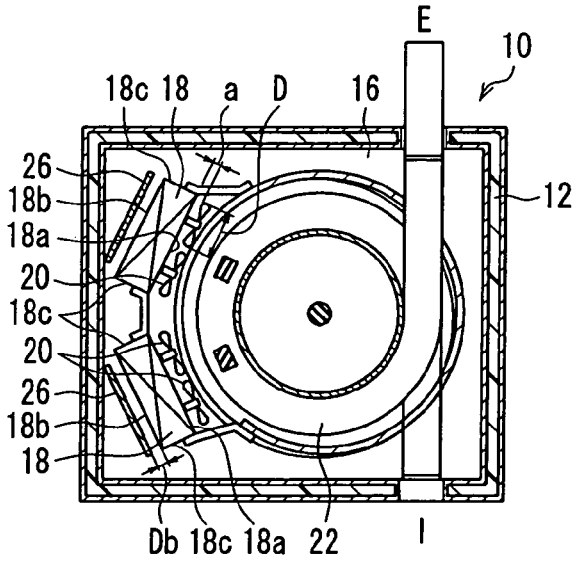
FIG. 13 is a sectional view in the case where the present invention is applied to a cooling device in a spiral freezer.
Figure 14:
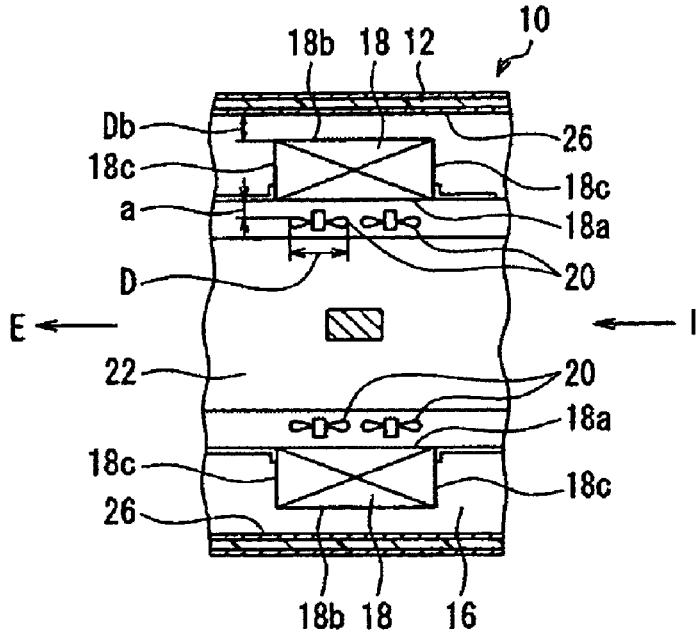
FIG. 14 is a partially sectional view in the case where the present invention is applied to a cooling device in a tunnel freezer.

The cooling device 10 is not limited to a device forming a sealed interior as shown in FIGS. 1A to 1B but can be applied to a cooling device disposed in a line such as a spiral freezer provided with a conveyor for conveying an object to be cooled spirally as shown in FIG. 13 or a tunnel freezer provided with a conveyor for conveying an object to be cooled horizontally as shown in FIG. 14. In this case, although the cooling device is provided with a carry-in entrance I and a carry-out exit E through which an object to be cooled is carried in and out, the interior 16 in the cooling device 10 is adiabatically insulated from an exterior by the heat-insulating wall 12. The present invention similarly can be applied to such freezers by setting a/D and Db in a similar manner.

Figure 15:
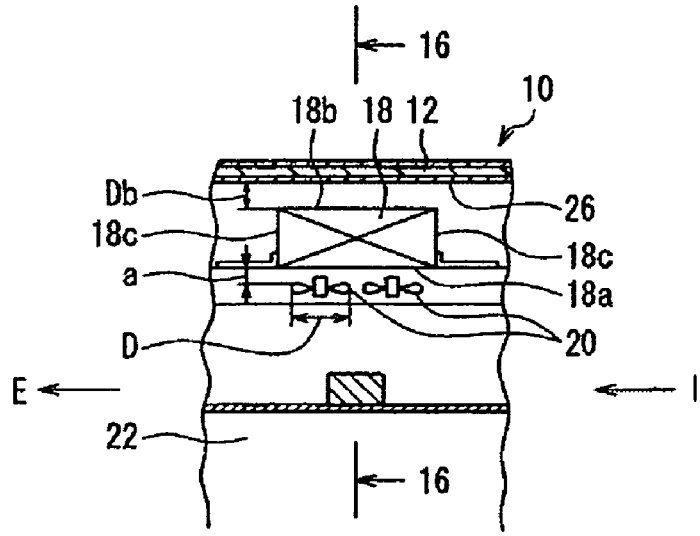
FIG. 15 is a partially sectional view illustrating an exemplary arrangement of a cooler and an object to be cooled in the present invention.
Figure 16:
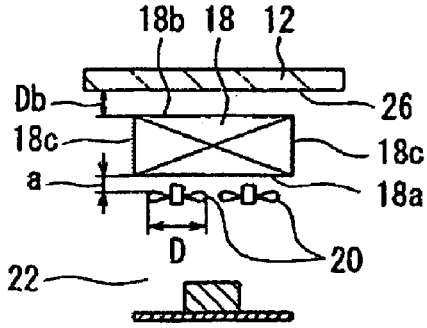
FIG. 16 is a view seen along a line 16-16 in FIG. 15.
Figure 17:
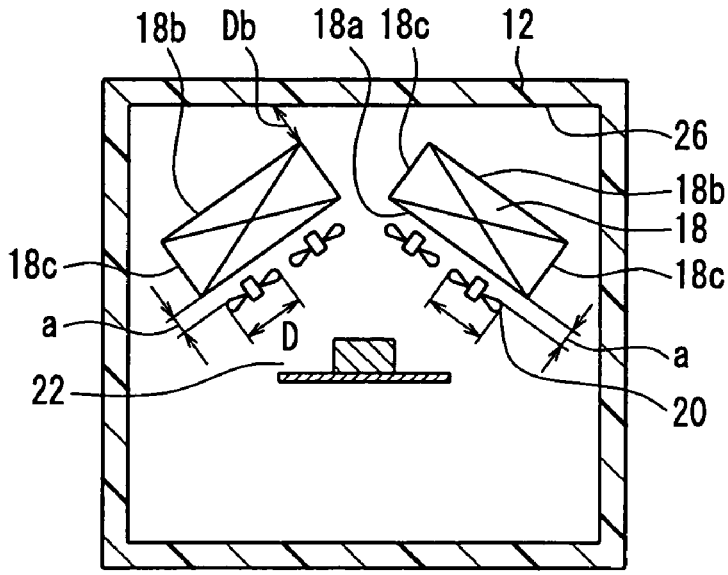
FIG. 17 is a sectional view illustrating an exemplary arrangement of the coolers and the object to be cooled in the present invention.
Figure 18:
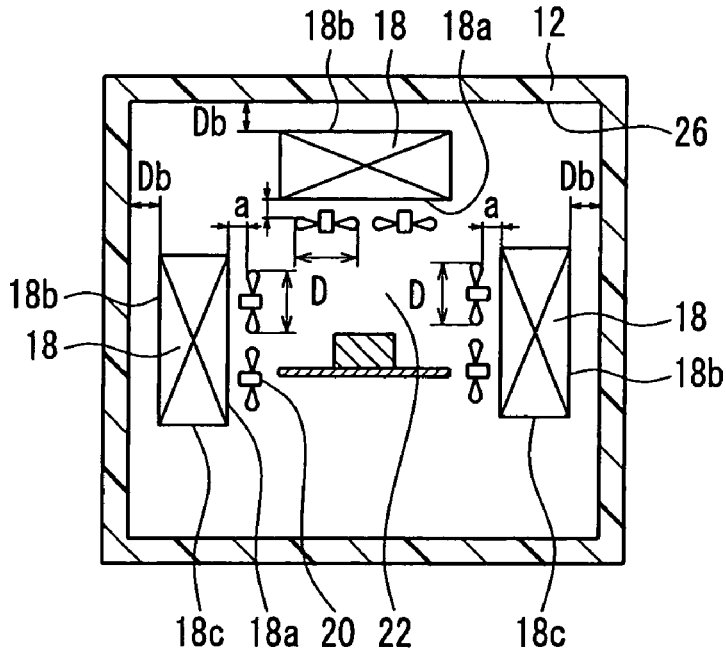
FIG. 18 is a sectional view illustrating an exemplary arrangement of the coolers and the object to be cooled in the present invention.

In the examples described above, the cooler has been arranged at a position spaced away horizontally from the object to be cooled. However, the present invention is not limited to such a position, and it should be appreciated that, no matter how the cooler is arranged three-dimensionally, the present invention similarly can be applied to the configuration in which the front surface of the cooler is provided with the cooling fans by setting a/D and Db in predetermined ranges. For example, FIGS. 15 and 16 illustrate examples in which the cooler 18 is arranged above the object to be cooled, FIG. 17 illustrates an example in which the coolers 18 are arranged obliquely above the object, and FIG. 18 illustrates an example in which the coolers 18 individually are arranged around the object. In FIGS. 16 to 18, the object to be cooled is carried in a direction perpendicular to the sheet of paper. In any given arrangements of the coolers and the object to be cooled such as those described above, the present invention can be applied similarly.

Explanation of Letters or Numerals

| | |
|---|---|
| 10 | Cooling device |
| 12 | Heat-insulating wall |
| 16 | Interior |
| 18 | Cooler |
| 20 | Cooling fan |
| 22 | Cooling chamber |
| 24 | Tray (Placement stage) |
| 30 | Vibration driving portion |

The invention claimed is:

1. A cooling device comprising a cooler provided in an interior that is insulated adiabatically from an exterior, a cooling fan disposed on a front surface of the cooler, and a cooling chamber that is defined by a space in front of the cooling fan and in which an object to be cooled is placed, the cooling device drawing coaled air behind the cooling fan with the fan, and allowing the cooled air to flow into the cooling chamber, wherein $\alpha/D=\frac{1}{2}$ to $\frac{1}{4}$ is satisfied so that an air flow is generated that comes from a side of the cooling chamber, moves around both lateral surfaces and a back surface of the cooler, and flows into the cooling chamber, whereby warmed air flowing from the side of the cooling chamber exchanges heat with ambient air of the cooler that has been cooled by the cooler, and then flows toward the cooling chamber, where $\alpha$indicates a dimension of a first gap between the cooler and the cooling fan along a front-back direction and D indicates a diameter of the cooling fan, a dimension of a second gap between the cooler and a wall surface on a back surface side of the cooler is set to be larger than 50 mm, and an air pressure at a point located 100 mm forward of a point of rotational center of the cooling fan is allowed to oscillate or pulse by adjusting a rate of revolutions of the cooling fan.

2. The cooling device according to claim 1, wherein an average pressure at the point located 100 mm forward ranges from 10 gf/cm$^2$ to 28 gf/cm$^2$.

3. The cooling device according to claim 1, wherein the rate of revolutions of the cooling fan is adjusted so that resonance occurs in the pressure oscillation or pressure pulsation when the dimension $\alpha$ is varied.

4. The cooling device according to claim 1, wherein a lateral surface of the cooler is covered with a control plate so as to prevent substantially air from moving in and out through the lateral surface of the cooler.

5. The cooling device according to claim 1, wherein the rate of revolutions of the cooling fan is adjustable.

6. The cooling device according to claim 5, wherein the rate of revolutions is 1200 to 2100 rpm.

7. The cooling device according to claim 1, wherein a vibration driving portion for vibrating a placement stage on which the object to be cooled is placed is provided in the cooling chamber.

8. The cooling device according to claim 1, wherein a plurality of the coolers are present, the coolers are provided so as to face each other with the cooling chamber interposed therebetween, and the cooling fans provided respectively on the front surfaces of the facing coolers are offset so as not to face each other.

9. The cooling device according to claim 1, wherein a number of the cooling fans provided on the front surface of the cooler is more than one, and when the front surface of the cooler is divided virtually into a plurality of blocks, the cooling fans are arranged on the front surface corresponding to blocks selected in a staggered manner.

10. The cooling device according to claim 1, wherein a rotation of the cooling fan is set to be counterclockwise in the Northern Hemisphere and clockwise in the Southern Hemisphere.

11. The cooling device according to claim 1, wherein both of a maximal value of a frequency (Hz) of the pressure oscillation or pressure pulsation and a maximal value of an amplitude relative to pressure ($T/P_{ave}$), which is the ratio of an amplitude T of the pressure oscillation or pressure pulsation to the average pressure $P_{ave}$, are present in a vicinity of $\alpha/D=1/4$.

12. The cooling device according to claim 1, wherein the cooling device is a sealed interior cooling device, a spiral freezer cooling device provided with a conveyor for conveying the object to be cooled spirally or a tunnel freezer cooling device provided with a conveyor for conveying the object to be cooled horizontally.

* * * * *